United States Patent [19]

Callegari

[11] 4,444,412

[45] Apr. 24, 1984

[54] REAR FASTENING FOR CROSS COUNTRY SKI

[75] Inventor: Mario Callegari, Montebelluna, Italy

[73] Assignee: Calzaturificio Binnaig di Bonsembiante Gianni, Cusignana di Giavera, Italy

[21] Appl. No.: 349,193

[22] Filed: Feb. 17, 1982

[30] Foreign Application Priority Data

Feb. 18, 1981 [IT] Italy ..... 61916/81[U]
Jan. 22, 1982 [IT] Italy ..... 84104 A/82

[51] Int. Cl.[3] ..... A63C 9/00

[52] U.S. Cl. ..... 280/614; 280/627; 280/633

[58] Field of Search ..... 292/139, 177, DIG. 49, 292/DIG. 60; 280/614, 626, 627, 631, 632, 634, 633

[56] References Cited

U.S. PATENT DOCUMENTS

| | | | |
|---|---|---|---|
| 3,189,362 | 6/1965 | Weberling | 280/627 |
| 3,620,545 | 11/1971 | Korger et al. | 280/633 X |
| 3,733,083 | 5/1973 | Berchtold | 280/633 |
| 3,936,065 | 2/1976 | Ramillon | 280/633 |
| 4,261,595 | 4/1981 | Smialowski et al. | 280/614 |

FOREIGN PATENT DOCUMENTS

| | | | |
|---|---|---|---|
| 619618 | 10/1980 | Switzerland | 280/614 |

*Primary Examiner*—David M. Mitchell
*Assistant Examiner*—Michael Mar
*Attorney, Agent, or Firm*—D. Paul Weaver

[57] ABSTRACT

A cross country ski rear fastening includes a body fixed on the ski, a resiliently biased fork member movable on the body for locking the footwear heel, and a lever system operable by the skier and connected with and acting on the fork member to cause engagement of the latter with the heel on overcoming a dead center position of the lever system and the biasing force on the fork member.

4 Claims, 4 Drawing Figures

REAR FASTENING FOR CROSS COUNTRY SKI

Figure 1:
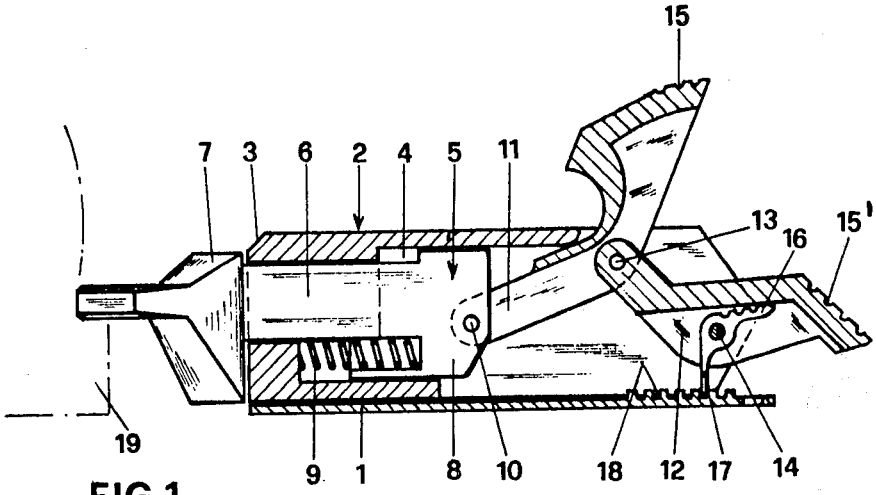

The present invention relates to a cross-country ski rear fastening.

Well known are cross-country ski rear fastenings comprising generally a fork located near the footwear heel and suitable for engaging it in particular situations, such as for example during the down-hills or jumps, in order to allow an easy control of the ski.

Such known ski fastenings show some drawbacks and in particular:

- they require the transformation of the footwear for the fitting of a engagement spur to the fork,
- they do not ensure the ski control in case of jump,
- they require an uncomfortable hand-driven action by the skier,
- they do not allow the disengagement of the footwear in case of accidental fall of the skier,
- they have a limited field of application to footwear of different sizes, and in some cases they require new holes in the ski itself.

An object of the invention is to realize a cross-country ski rear fastening which may be easily operated by the skier by means of the racket or also of the other ski.

Another object of the invention is to realize a cross-country ski rear fastening which allows the disengagement of the ski in case of falls of the skier.

Another object of the invention is to realize a cross-country ski rear fastening which may be adaptable within a wide range to footwear of different sizes.

Such objects are attained, according to the invention, with a cross-country ski rear fastening characterized in that it comprises

- a body to be fastened to the ski,
- a fork-shaped member for locking the footwear heel, mounted on a stem substantially horizontal and axially movable with respect to said body between a front position of engagement of the heel and a rear position of disengagement,
- a spring means biasing the stem in the extreme rear position,
- a lever system, operable by the skier, and acting on the fork-shaped member causing the engagement of the footwear heel on overcoming a dead position and the biasing force.

Still according to the invention the levers may be provided with an actuation portion having a high surface friction.

Advantageously the fastening may comprise an anchoring bracket in which said body may be amovably inserted and longitudinally moved.

Still according to the invention a lever may be pivotally connected to the body, said lever being provided with a little tooth engaging a corresponding toothed portion of the bracket.

Still according to the invention a threaded rod and an adjusting bushing engaging one another may be provided between the body and the bracket.

Advantageously a means actuated by the stem may act on the lever system when the stem is flexurally stressed in a vertical plane, said means acting so as to cause the disengagement of the heel by the fork-shaped member, when the flexural stress overcomes a prefixed degree.

Still according to the invention the means acting on the lever system may comprise a rocker having an arm actuated by the stem and the other arm acting on the lever system.

Advantageously the fastening may comprise an adjustment member of the prefixed intensity value, which causes the disengagement of the heel by the fork-shaped member.

Figure 2:
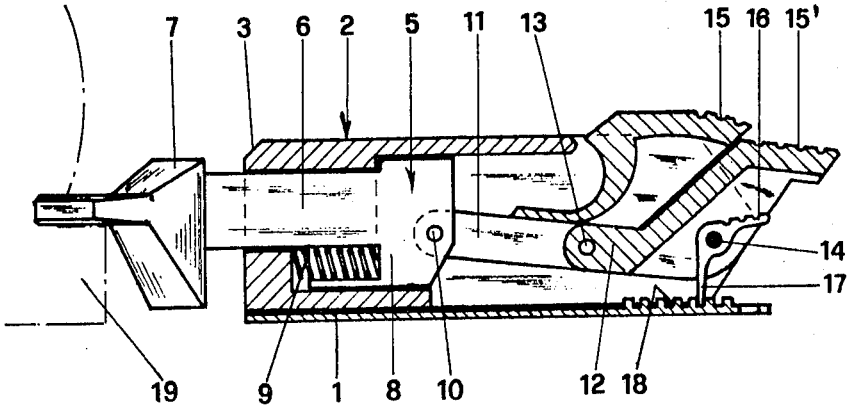
Figure 3:
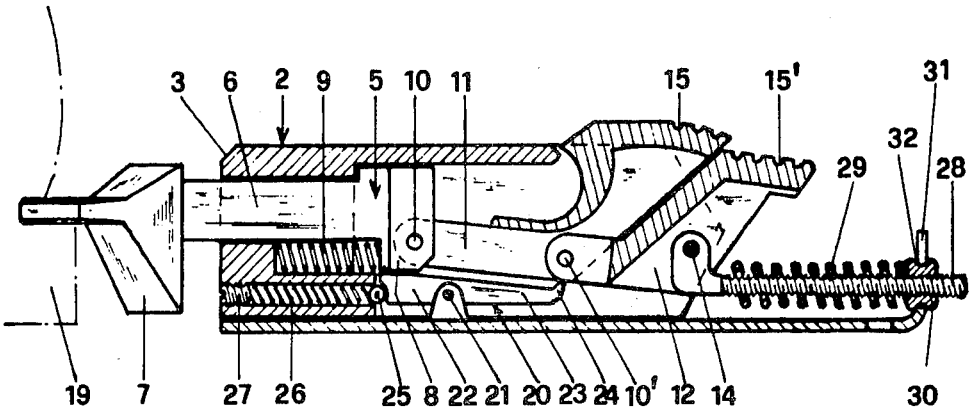
Figure 4:
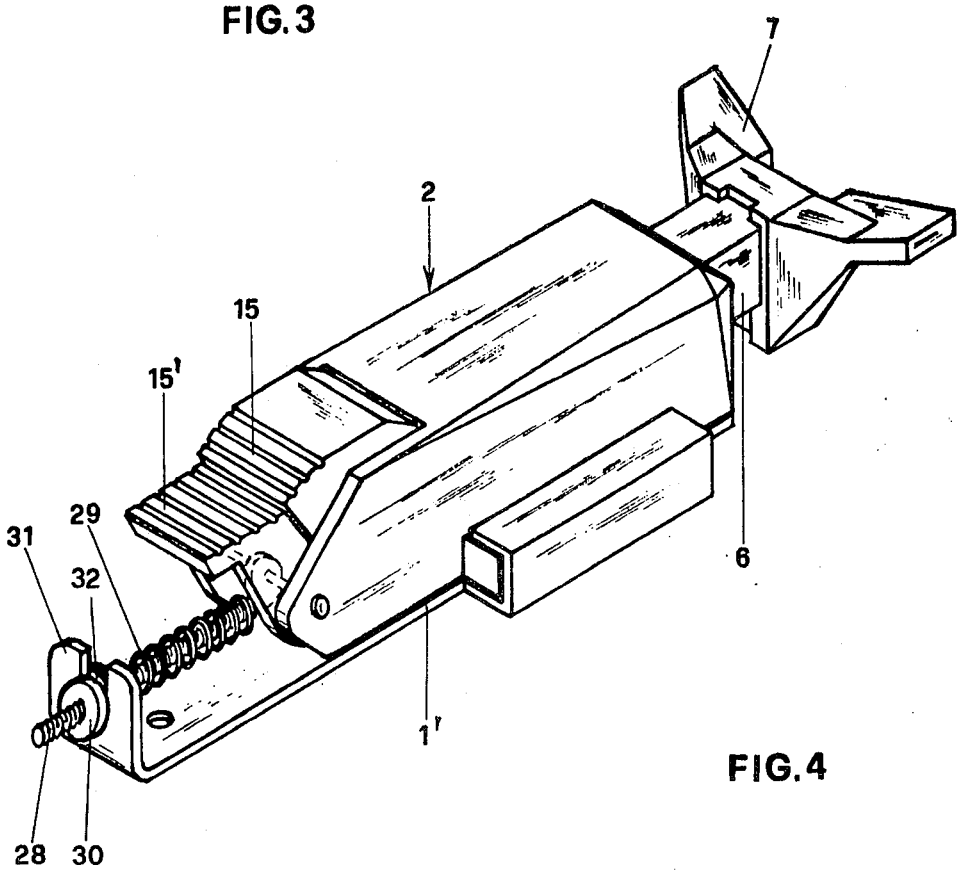

The present invention is hereinafter further disclosed in two preferred embodiments, according to the accompanying drawings, in which:

FIG. 1 shows in longitudinal sectional view the ski fastening according to the invention mounted on an anchoring bracket and in condition of disengagement of the footwear heel, FIG. 2 shows it in the same view as in FIG. 1 in condition of engagement, FIG. 3 shows it in the same view as in FIG. 2 mounted on a differently shaped bracket and provided with a safety device, and FIG. 4 shows it in the same embodiment of FIG. 3 but in perspective rear view.

As shown in the FIGS. 1 and 2 the cross-country ski rear fastening according to the invention comprises a bracket 1, bound to the ski by screws, and a body 2 sliding along said bracket. In the front portion 3 of the body 2 a cavity 4 is provided, into which a heel-locking element 5 slids. It essentially comprises a stem 6, bearing at the front end a fork-shaped element 7, adjustable in height in traditional manner, and having a shape substantially complementary to the rear profile of the footwear heel 19.

The rear end of the stem 6 is provided with a projecting portion 8 for engagement of a spring 9, which, in absence of external stresses, mantains the heel-locking element 5 disengaged, FIG. 1.

The rear end of the stem 6 is moreover pivoted, through a pin 10, to a lever 11, which is pivotally connected, through a pin 13, to another lever 12. This lever 12 is pivotally connected to the body 2 by a pin 14.

The lever 11 is provided with an actuating surface, which, when the fastening is in engagement condition, is substantially coplanar with a corresponding actuating surface of the lever 12. Furthermore, these actuating surfaces are provided with knurlings 15,15', and in any case are shaped so as to offer a high friction, for the easy engagement by the point of the racket.

To the same articulation pin 14 of the lever 12 to the body 2, a smaller lever 16 is pivotally connected, which is housed in a cavity below said lever 12 and provided with a small tooth 17 for engaging a corresponding toothed portion of the bracket 1. A spring, not shown in the drawings, elastically maintains said lever 16 in engagement condition.

The fastening according to the invention operates as follows:

In normal conditions the heel-locking element 5 is held in the rear position by the spring 9. In such a condition the axis of the pin 13 is appreciably located above the plane passing through the axes of the pins 10 and 14.

For locking the footwear heel 19, i.e. in the case of down-hill or jump, the skier presses with the point of the racket the knurled portion 15 of the lever 11, thus causing the heel-locking element 5, to overcome the reaction of the spring 9, and move forward and engage the fork-shaped element 7 said heel 19 (cf. FIG. 2). The stability of this engagement position is ensured by the passage of the axis of the pin 13 below the plane passing through the axes of the pins 10 and 14.

During the movement of the stem 6 its rectangular section shape prevents any axial rotation of the same and of the fork-shaped element 7 connected to it.

For disengaging the heel-locking element 5 from the footwear heel 19, the skier presses with the racket on the knurled portion 15' of the lever 12, thus causing its rotation around the pin 14 and consequently letting raise the lever 11. In this way the elastic reaction of the spring 9 prevails, which moves the heel-locking element 5 rearwardly and disengages the fork-shaped element 7 from the footwear heel 19.

For adjusting the position of the body 2 along the bracket 1, one acts on the lever 16 and disengages the small tooth 17 from the toothed portion 18 of said bracket 1. Following this the body 2 is moved along the bracket until the new desired position is reached. On releasing the lever 16, its spring returns the small tooth 17 to the engagement configuration.

In a different embodiment (cf. FIG. 3) inside the body 2 a rocker 20 is mounted on a horizontal pin 21. An arm 22 of the rocker 20 is substantially in touch with the projecting portion 8 of the stem 6, while the other arm 23 is provided with a sharp-pointed projecting portion 24, turned upwards and located almost below the articulation pin 10 of the levers 11 and 12 when the fastening is engaged.

At the end of the arm 22 a spherical cavity is provided, to which elastically adheres a sphere 25 pushed by a solenoidal spring 26. This spring is housed in a cylindrical cavity of the body 2, closed by an adjustment screw 27, which may be actuated from the outside.

The body 2 of the fastening is fixed to a horizontal threaded rod 28, wrapped around which is a coil spring 29. At the end of the rod 28 a threaded bushing 30 is provided, having an external circumferential groove 32 engaged by a fork 31 formed on a rear extension of the bracket 1'.

Regarding the engagement and disengagement operations, the ski fastening according to the invention works in the same manner as the precedent embodiment; regarding to the safety device, in case of a fall by the skier, the irregular movement of the foot is transmitted to the heel-locking element 5 and the small clearance between the stem 6 and its parallelepipedic guide cavity 4 allows its small angular movement in the vertical plane. Owing to such a movement its projecting portion 8 presses on the arm 21 of the rocker 20, thus causing the lifting of the projecting portion 24 of the other arm 23. This projecting portion 24 pushes the articulation pin 13 above the plane passing through the axes of the pins 10 and 14. In such a way the elastic reaction of the spring 9 prevails, the stem 6 is pushed backwards and the fork-shaped element 7 is disengaged from the footwear heel 19.

It is to be noted that it is possible to adjust the intervention threshold of the projecting portion 8 on the rocker 20, by actuating the screw 27, which, through the spring 26, acts on the intensity of the force pushing the sphere 25 against the corresponding cavity of the rocker 20.

In order to adjust the position of the body 2 along the bracket 1', one acts the bushing 30 either in one or in the other rotation direction, thus causing the axial movement of the rod 28 and of the body 2 connected to them. The undesired rotations of the threaded bushing 30 are prevented by the spring 29, which always maintains them pushed against the fork 31.

It is also possible that the threaded rod 28, instead of being connected to the body 2, merely rests on them, so as to prevent its moving back. In such a way the forward movements of the fastening are always possible and allow to slip easily and without tools the body 2 from the bracket 1'.

From the above, it clearly appears that the cross-country ski rear fastening according to the invention offers several advantages, and in particular:

- it ensures an effective ski control in case of jump or down-hill,
- it may be easily actuated also by means of the skier's racket or also by means of the other ski,
- it may be used with footwear of every size, and it may be quickly adjusted to these,
- it has a limited size and is aesthetically agreeable,
- it is of sure reliability, being of simple operation and of substantial insensibility to the presence of snow or ice,
- it ensures the disengagement of the footwear in case of accidental fall by the skier,
- it allows adjustment of the intervention threshold of the safety device.

I claim:

1. A cross country ski rear fastener comprising a body adapted to be fastened to a ski, a forked member adapted to lock a footwear heel on a ski movably mounted on said body for fore and aft movement relative to footwear on a ski, spring means engaging the forked member and biasing it rearwardly toward a position of disengagement with the footwear heel, a lever system on the body having a connection with said forked member and operable by a skier to force the forked member forwardly into engagement with the footwear heel against the force of said spring means, the lever system having an over-dead-center locking position to hold the forked member engaged with the footwear heel, and a safety release means for said lever system including a rocker element having one end portion bearing on the lever system at an articulation point therein, and being resiliently biased at its other end portion toward engagement with a part of the forked member within said body.

2. A cross country ski rear fastener comprising a body adapted to be fastened to a ski, a forked member adapted to lock a footwear heel on a ski movably mounted on said body for fore and aft movement relative to footwear on a ski, spring means engaging the forked member and biasing it rearwardly toward a position of disengagement with the footwear heel, a lever system on the body having a connection with said forked member and operable by a skier to force the forked member forwardly into engagement with the footwear heel against the force of said spring means, the lever system having an over-dead-center locking position to hold the forked member engaged with the footwear heel, and an anchoring bracket fixed on the ski and receiving said body movably, a fore and aft adjuster for the body on said bracket connected between the body and bracket, said lever system comprising a pair of articulated levers connected between the body and adjuster, a rocker arm on the bracket having one end bearing on the articulation joint of said levers and having an extension in a path of movement of a portion of the forked member within the body, and adjustable resilient means connected with the extension of the rocker arm and biasing it toward engagement with the portion of said forked member.

3. A cross country ski rear fastener as defined in claim 2, and the adjustable resilient means comprising a spring disposed within a bore of said body, a threaded plug in said bore to adjust the tension of said spring, and a spherical element engaged between one end of the spring and a spherical cavity formed in the extension of the rocker arm.

4. A cross country ski rear fastener comprising a body adapted to be fastened to a ski, a forked member adapted to lock a footwear heel on a ski movably mounted on said body for fore and aft movement relative to footwear on a ski, spring means engaging the forked member and biasing it rearwardly toward a position of disengagement with the footwear heel, a lever system on the body having a connection with said forked member and operable by a skier to force the forked member forwardly into engagement with the footwear heel against the force of said spring means, the lever system having an over-dead-center locking position to hold the forked member engaged with the footwear heel, a bracket fixed on the ski and supporting said body movably for longitudinal adjustment, and a threaded longitudinal adjuster connected between said body and bracket, said threaded longitudinal adjuster comprising a threaded rod connected between an upturned part of said bracket and a pivot element of said lever system, a threaded bushing on the threaded rod rotatably engaged with said upturned part, and a coil spring on the threaded rod bearing against said bushing.

* * * * *